US007614718B2

(12) United States Patent
Chen et al.

(10) Patent No.: US 7,614,718 B2
(45) Date of Patent: Nov. 10, 2009

(54) AUTOMATIC IDENTIFICATION SYSTEM AND METHOD FOR PRINTER RECORDABLE MEDIA

(75) Inventors: Yi-Che Chen, Baoshan Township, Hsinchu County (TW); Yu-Chu Huang, Taipei (TW)

(73) Assignee: Sunplus Technology Co., Ltd., Hsinchu (TW)

( * ) Notice: Subject to any disclaimer, the term of this patent is extended or adjusted under 35 U.S.C. 154(b) by 660 days.

(21) Appl. No.: 11/401,236

(22) Filed: Apr. 11, 2006

(65) Prior Publication Data

US 2006/0239748 A1 Oct. 26, 2006

(30) Foreign Application Priority Data

Apr. 13, 2005 (TW) ..... 94111624 A

(51) Int. Cl.
*B41J 29/393* (2006.01)

(52) U.S. Cl. ..... 347/19

(58) Field of Classification Search ..... 347/16, 347/14, 19, 105; 73/159, 597, 598, 602; 250/559.16

See application file for complete search history.

(56) References Cited

U.S. PATENT DOCUMENTS

| | | | | |
|---|---|---|---|---|
| 6,047,100 | A | 4/2000 | McLaren | 386/68 |
| 6,322,192 | B1 | 11/2001 | Walker | 347/19 |
| 6,863,363 | B2 * | 3/2005 | Yabuta | 347/19 |
| 6,900,449 | B2 * | 5/2005 | Bolash et al. | 250/559.16 |
| 7,082,832 | B2 * | 8/2006 | Yabuta et al. | 73/597 |
| 7,533,954 | B2 * | 5/2009 | Nakazawa et al. | 347/16 |

* cited by examiner

*Primary Examiner*—Lamson D Nguyen
(74) *Attorney, Agent, or Firm*—Bacon & Thomas, PLLC

(57) ABSTRACT

An automatic identification system and method for printer recordable media, which detects two or more different record media to be printed by a printer. The different record media have different load features. The system includes a transport device, a driving device, a photo encoder, a photosensor and a processor. The transport device delivers different record media. The driving device drives the transport device. The photo encoder is implemented on the transport device such that when the transport device delivers the different record media, the photo encoder can produce a position signal respectively of the different record media. The photosensor detects the position signals. The processor receives and processes the position signals to thus identify the different record media.

9 Claims, 5 Drawing Sheets

AUTOMATIC IDENTIFICATION SYSTEM AND METHOD FOR PRINTER RECORDABLE MEDIA

BACKGROUND OF THE INVENTION

1. Field of the Invention

The invention relates to the technical field of printers and, more particularly, to an automatic identification system and method for printer recordable media.

2. Description of Related Art

Currently, a laser printer or inkjet printer, can typically perform printing on different record media such as plain paper, photographic paper and transparent slide. In order to obtain the best print quality, different printing methods are used in different record media. For example, an ink loading capability of photographic paper is different compared with plain paper's. Accordingly, even when the same image is printed, color processing, halftone and even dot-superimposition are different between the photographic paper and the plain paper, and a good print quality can thus be presented concurrently on the two papers.

In the past, the type of a record medium was determined by a user, and accordingly set by an application program of a host or directly to a printer through a user interface. However, such a way can easily cause mistakes and inconvenience to the user. In order to overcome this problem, U.S. Pat. No. 6,047,100 disclosed that a sign or barcode invisible to human eyesight is superimposed into a record medium in a printer, and read by a photosensor of the printer for identification. However, such an identification method can not only identify a record medium with the invisible sign or barcode, but also increase the manufacturing cost of such a record medium.

In order to overcome the aforementioned problem as shown in FIG. 1, U.S. Pat. No. 6,322,192 granted to Walker for a "Multi-function optical sensing system for inkjet printing" uses a light emitting diode (LED) to transmit light onto the surface of a record medium in a printer, and a photosensor to receive a reflected light from the surface. Because the surfaces of different record media have different reflective features, the types of the different record media can be identified by the signals received from the reflected lights. Though this method does not require any special processing on the record media, it does require an additional LED and photosensor. Besides, an analog to digital (A/D) converter is also added to the printer for identification of a signal received by the photosensor. Thus, the hardware cost is relatively increased. Further, if the type of a reflected light is beyond the range of a type predefined by a printer manufacturer, a record medium corresponding to the reflected light cannot be determined. Thus, a non-standard printing paper without definition by printer manufacturers cannot be identified automatically, so that the quality of printing cannot be guaranteed.

Therefore, it is desirable to provide an improved system and method to mitigate and/or obviate the aforementioned problems.

SUMMARY OF THE INVENTION

The object of the invention is to provide an automatic identification system and method for printer recordable media, which can avoid the prior problems of requiring special processing for a record medium in a printer and using an additional LED and photosensor, thereby reducing the cost.

In accordance with one aspect of the present invention, there is provided an automatic identification system for printer recordable media. The system detects two or more different record media to be printed by a printer. The different record media have different load features. The system includes a transport device, a driving device, a photo encoder, a photosensor and a processor. The transport device delivers the different record media. The driving device is connected to the transport device and drives the gear. The photo encoder is configured on the transport device such that the photo encoder produces a position signal respectively of the different record media when the transport device delivers the different record media. The photosensor is connected to the photo encoder and detects the position signals. The processor receives and processes the position signals to thus identify the different record media.

In accordance with another aspect of the present invention, there is provided an automatic identification system for printer recordable media. The system detects two or more different record media to be printed by a printer. The different record media have different load features. The system includes a transport device, a motor, a photo encoder, a photosensor and a processor. The transport device delivers the different record media. The motor is connected to the transport device and drives the transport device. The photo encoder is configured on the transport device such that the photo encoder produces a position signal respectively of the different record media when the transport device delivers the different record media. The photosensor is connected to the photo encoder and detects the position signals. The processor receives and processes the position signals to thus identify the different record media. The motor is rotated with a predetermined torque for a predetermined time. Because of the different load features, the transport device delivers the different record media to different positions in accordance with the load features respectively of the different record media. The processor identifies the different record media in accordance with the different positions.

In accordance with a further feature of the present invention, there is provided an automatic identification method for printer recordable media. The method detects two or more different record media to be printed by a printer and uses a transport device to deliver the different record media. The different record media have different load features. The method includes the steps of: (A) delivering the different record media to a predetermined position; (B) using the transport device to subsequently deliver the different record media at a predetermined torque for a predetermined time; (C) detecting positions of the different record media; and (D) identifying the different record media in accordance with the positions.

In accordance with a further feature of the present invention, there is provided an automatic identification method for printer recordable media. The method detects two or more different record media to be printed by a printer and uses a transport device to deliver the different record media. The different record media have different load features. The method includes the steps of: (A) delivering the different record media to a predetermined position; (B) using the transport device to subsequently deliver the different record media at a predetermined torque to a predetermined position; (C) measuring respective time that the different record media are delivered respectively to the predetermined position; and (D) identifying the different record media in accordance with the respective time.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
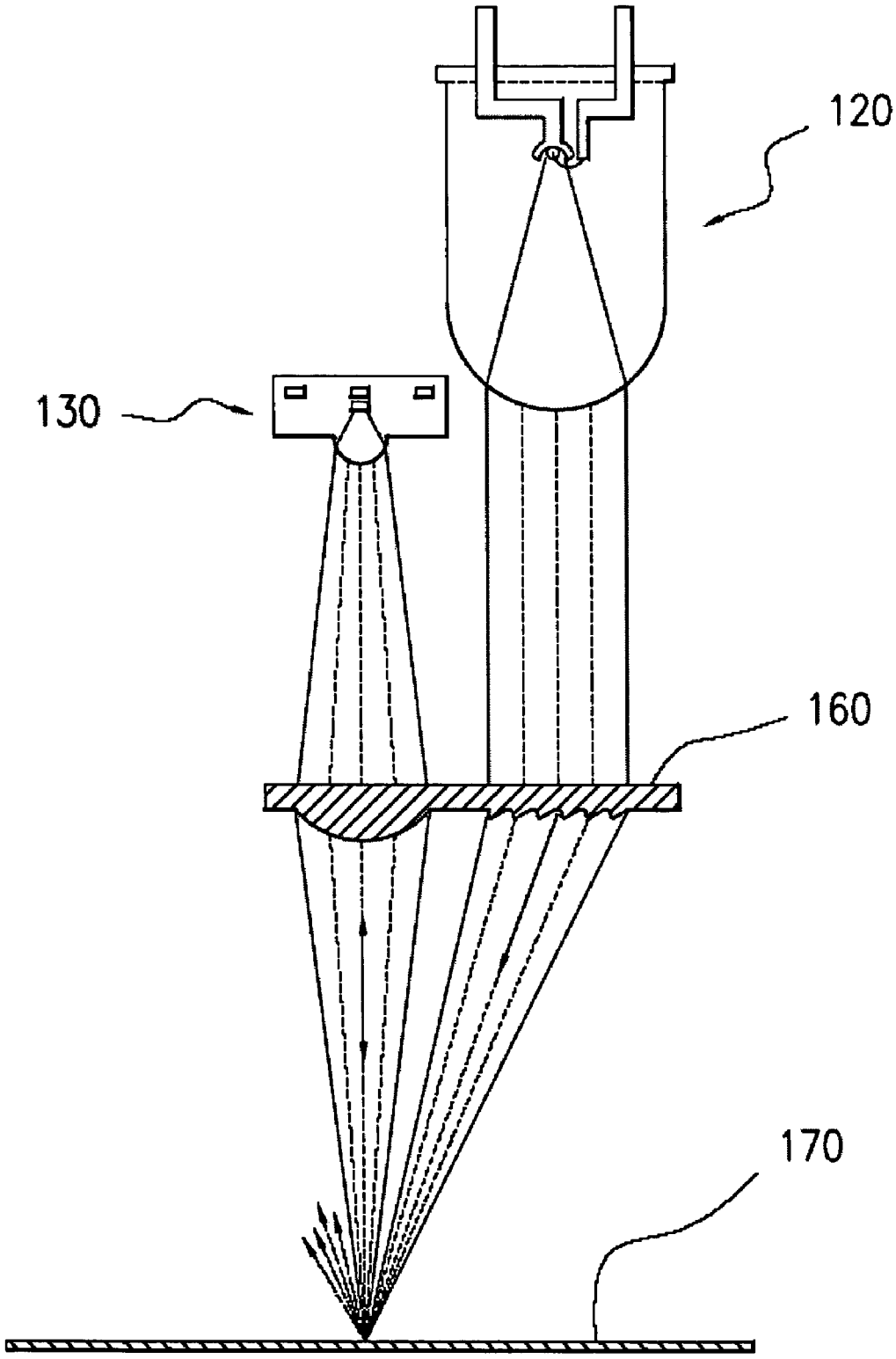
FIG. 1 PRIOR ART
FIG. 1 is a schematic view of a surface of a record medium typically irradiated by a light emitting diode (LED)
Figure 2:
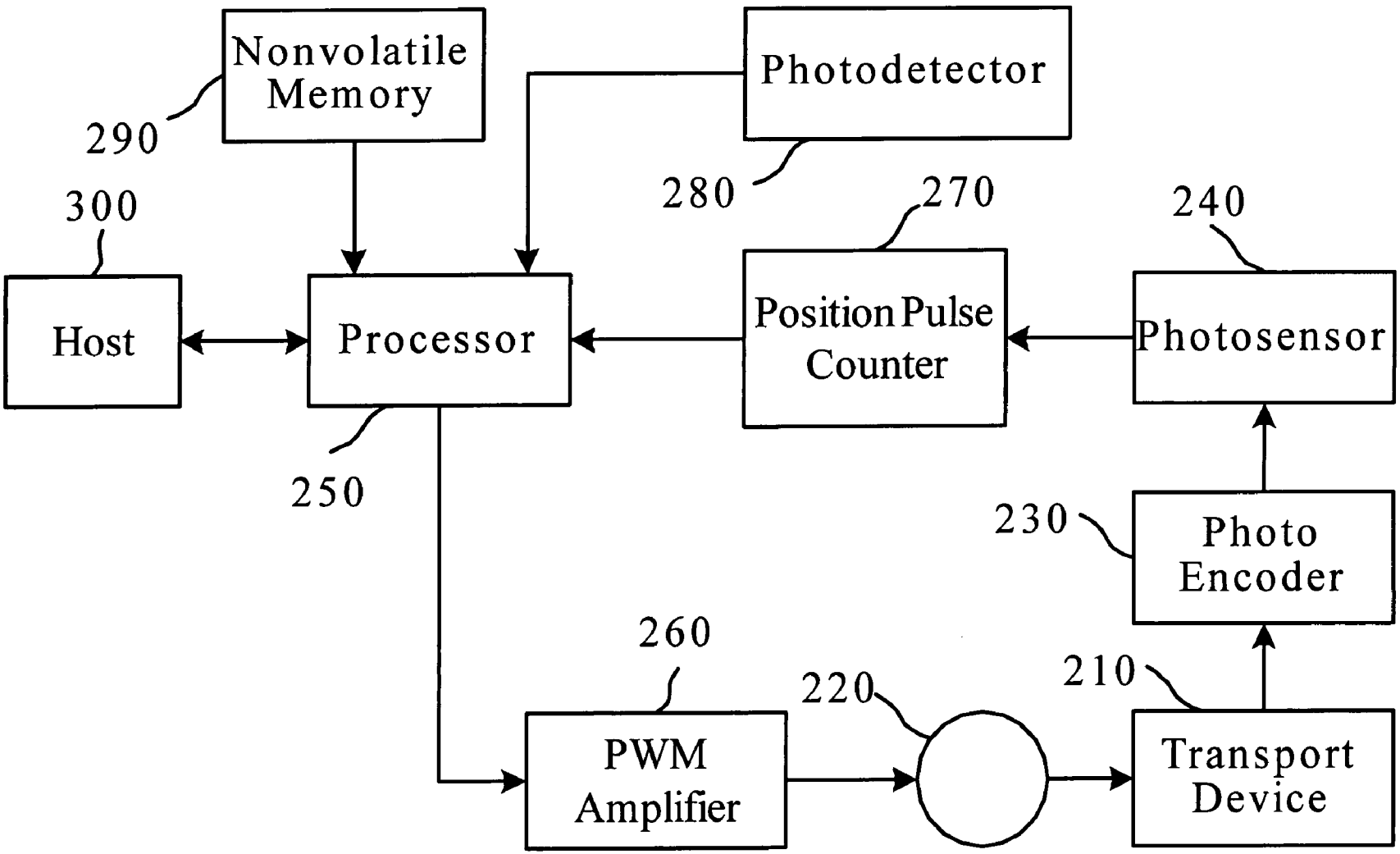
FIG. 2 is a block diagram of an automatic identification system for printer recordable media in accordance with the invention.

FIG. 2 is a block diagram of an automatic identification system for printer recordable media in accordance with the invention, which can detect the different record media to be printed in a printer. The different record media have different load features. The system includes a transport device 210, a driving device 220, a photo encoder 230, a photosensor 240, a processor 250, an amplifier 260, a position pulse counter 270, a photodetector 280 and a nonvolatile memory 290.

The transport device 210 delivers two or more different record media. The driving device 220 is connected to the transport device 210 and drives it. The driving device 220 can be a motor.

The photo encoder 230 is configured on the transport device 210 such that when the transport device 210 delivers the two or more different record media, the photo encoder 230 produces a position signal respectively of the different record media. The photosensor 240 is connected to the photo encoder 230 to detect the position signals. The position pulse counter 270 converts the position signals into digital position signals. The processor 250 receives and processes the digital position signals to thus identify the different record media. The processor 250 is connected to a host 300. Typically, the host is a personal computer (PC) for downloading a printed file to the printer. The host 300 also functions as a user interface to receive a return message sent by the printer for displaying the printer status.

The amplifier 260 is connected to the driving device 220 and outputs a control signal to cause the driving device 220 to rotate with a predetermined torque for predetermined time. The amplifier 260 can be a pulse width modulation (PWM) amplifier. The photodetector 280 is connected to the processor 250. When the photodetector 280 detects the record media has reached a predetermined position, the photodetector 280 generates a locating signal and sends the locating signal to the processor 250. The nonvolatile memory 290 is connected to the processor 250 and records the respective positions of the different record media when the driving device 220 is rotated with the predetermined torque for a predetermined time.

When the driving device 220 is rotated with the predetermined torque for the predetermined time, the transport device 210 can deliver the different record media to the different positions because the different record media have different load features. Thus, the processor 250 can identify the different record media in accordance with the different positions.

Figure 3:
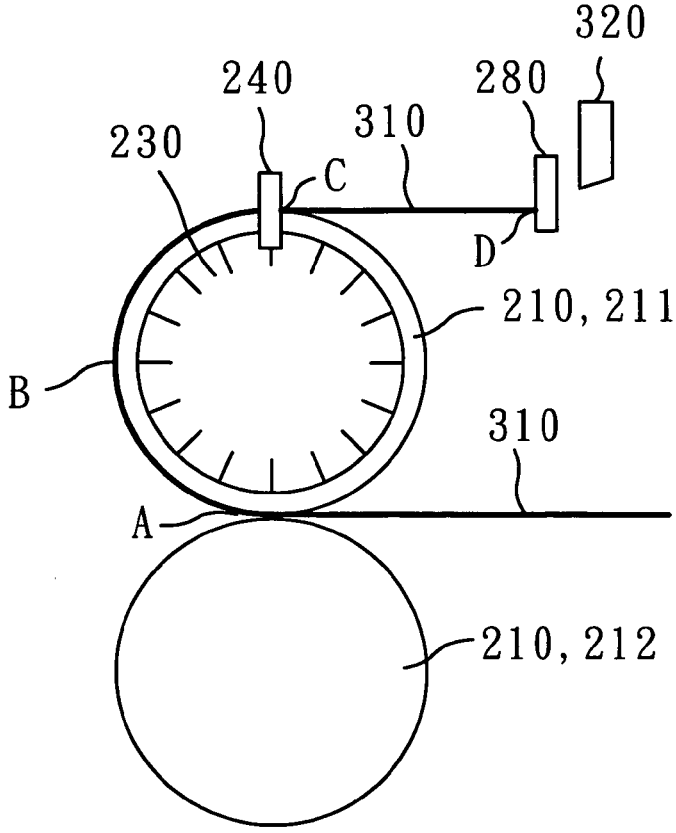
FIG. 3 is a schematic view of a U-type paper feed mechanism in accordance with the invention.
Figure 4:
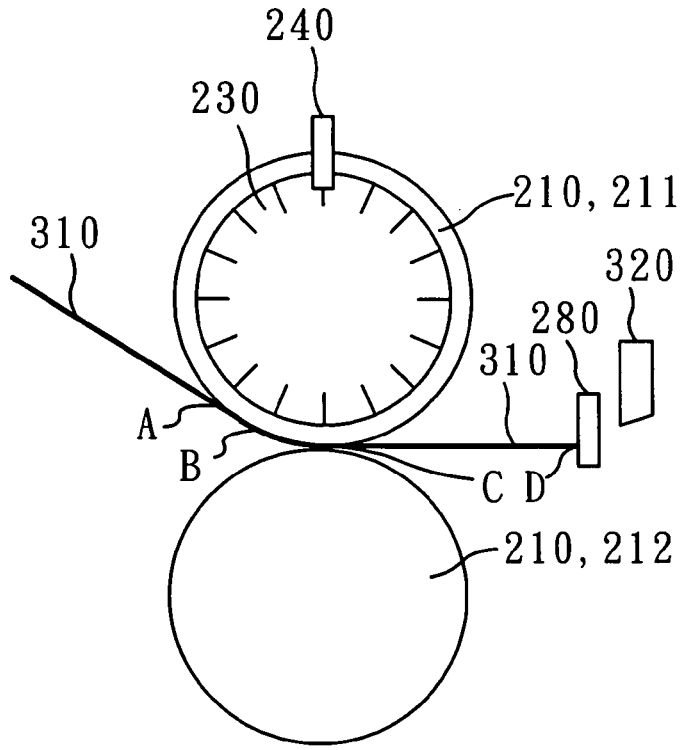
FIG. 4 is a schematic view of an L-type paper feed mechanism in accordance with the invention.

FIG. 3 is a schematic view of a U-type paper feed mechanism in accordance with the invention. FIG. 4 is a schematic view of an L-type paper feed mechanism in accordance with the invention. As shown in FIGS. 3 and 4, the paper feed mechanism essentially includes the transport device 210, the photo encoder 230, the photosensor 240, the photodetector 280, a record medium 310 and a print element 320. The transport device 210 includes a first roller 211 and a second roller 212. The axes of the first and the second rollers 211 and 212 are parallel to each other. The print element 320 can be an inkjet head, laser emitter or thermal sensitive head. Namely, the print element 320 is the inkjet head in an inkjet printer, the laser emitter in a laser printer, or the thermal sensitive head in a thermal printer. The record medium 310 includes an opaque record medium (plain or photo paper), and a transparent record medium (slide).

When the driving device 220 drives the transport device 210, the friction between the rollers of the transport device 210 and the record medium 310 can transfer the record medium 310. When the record medium 310 advances to a position under the print element 320, printing is operated. The paper feed mechanism of the printer uses a DC motor 220 to cooperate with the photo encoder 230. Such a way can accurately control the position of the record medium 310 through a feedback of the photo encoder 230. When the DC motor 220 brings the rollers 211, 212 to rotate together, the photosensor 240 sends position messages to the processor 250 for a position control of the record medium 310. In addition to the photo encoder 230, to detect whether a paper is present or not and if so, its absolute position, the photodetector 280 is implemented in a paper feed path. When the leading edge of the paper reaches the photodetector 280, the photodetector 280 sends a signal to the processor 250. In view of the foregoing, the inventive method uses the DC motor 220, photo encoder 230, photosensor 240 and photodetector 280 present in the printer to achieve the purpose of automated printing media identification.

In addition to different surface reflective features, the different record media 310 have different thicknesses and weights. For example, plain paper is the thinnest and the lightest among photographic paper, plain paper and transparent slide; transparent slide is next; and photo paper is the last. The different weight can cause different loads to the DC motor 220, which is referred to as "load feature". Accordingly, printing materials can be identified automatically. In the process of sending the record medium 310, different load features can be presented as follows:

1. If the DC motor 220 rotates at the same torque for the same applied time, different loads of the record media have different acceleration, speeds and displacement;

2. If the DC motor 220 rotates at the same torque for the same applied time, the time required by record media with different load features is different; and 3. If the DC motor 220 rotates for the same applied time, motor output torque required by record media with different load features is different.

Accordingly, the inventive automatic identification of the record media 310 can be performed.

Figure 5:
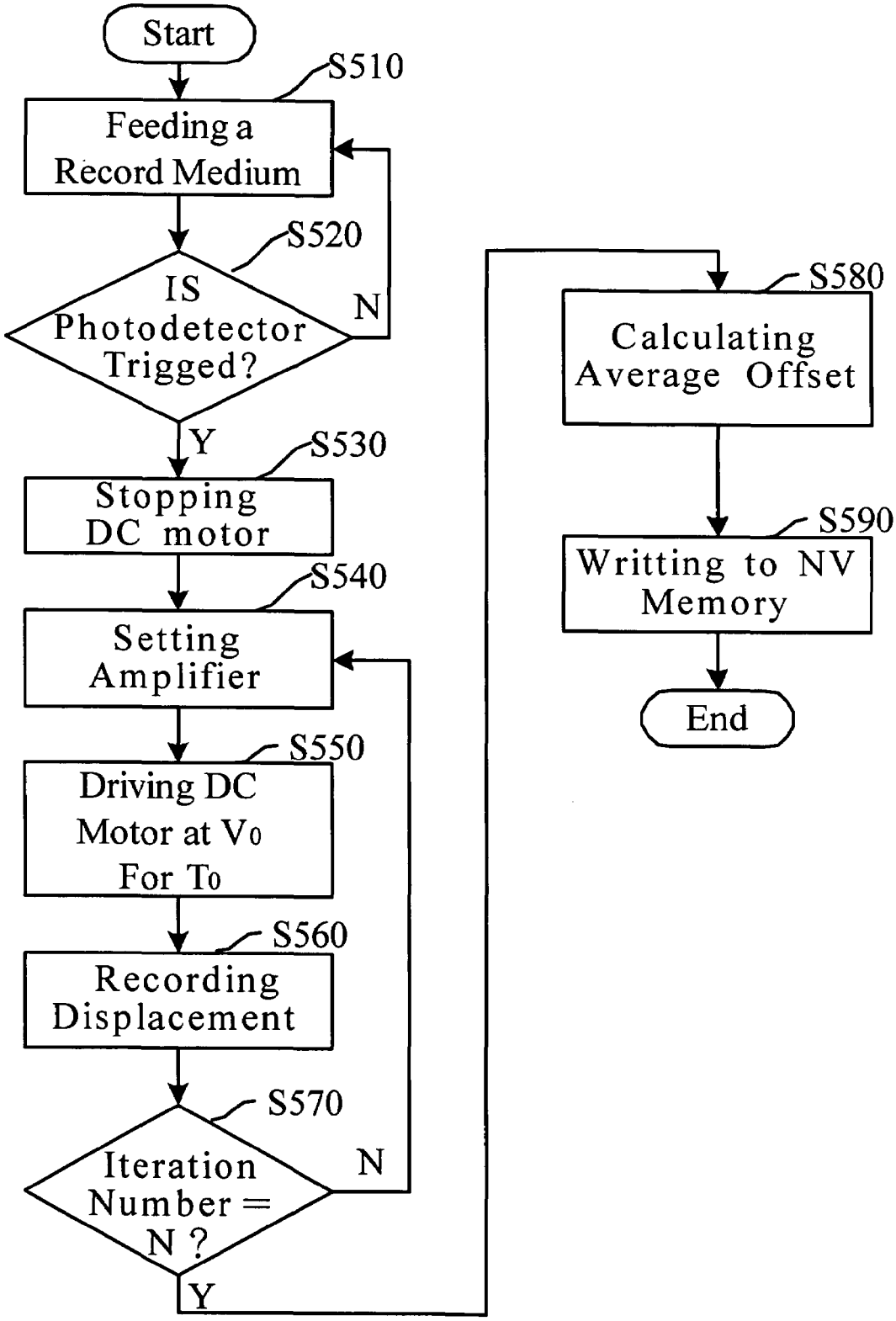
FIG. 5 is a flowchart for generating a load feature of a printer recordable medium in accordance with the invention.

FIG. 5 is a flowchart for generating a load feature of a printer recordable medium in accordance with the invention, which establishes a load feature database of standard media. As shown in FIG. 5, in step S510, a record medium 310 is selected and placed in a paper feed cartridge, and then the DC motor 330 transports the record medium 310. Referring again to FIGS. 3 and 4, when the leading edge of the record medium 310 is at point A or B, due to the initial inertia and friction, a displacement of the record medium 310 measured from the point A or B has great error. In order to reduce the measurement error of the displacement of the record medium 310, step S520 periodically checks if the leading edge of the record medium 310 triggers the photodetector 280. When the photodetector 280 is triggered, it indicates that the leading edge of the record medium 310 has reached the point D. The photosensor 240 can also be used to detect that the leading edge of the record medium 310 has reached point C.

Step S530 immediately stops the DC motor 220 and starts to measure the load feature of printing material of the record medium 310 based on the point C or point D. Step S540 sets an output of the amplifier 260 to $V_o$ volts, which can overcome the maximum static inertia friction of the record medium 310 at least and allow the record medium 310 to move. Step S550 drives the DC motor 220 at $V_o$ for $T_o$. Step S560 stops the DC motor 220 and records a displacement fed back by the photosensor 240.

Step S570 executes steps S540 to S560 N times. Step S580 calculates an average displacement based on the N times executed. Step S590 accordingly writes the average displacement in the non-volatile memory 290 to indicate the load feature of the record medium 310. Accordingly, the respective load features of different record media 310 can be measured and their average offsets are recorded in the non-volatile memory 290 as a database of the respective load features of the different media 310. Table 1 is a practical result with a motor driving voltage $V_o$=18 volts and a working time $T_o$=200 ms for a typical U-type paper feed mechanism.

TABLE 1

| | Printing Paper Type | | | |
|---|---|---|---|---|
| | Photo Paper | Inkjet Paper | Plain Paper | Transparent Slide |
| Average Offset Unit (1/2400 inch) | 10 | 80 | 100 | 30 |

Figure 6:
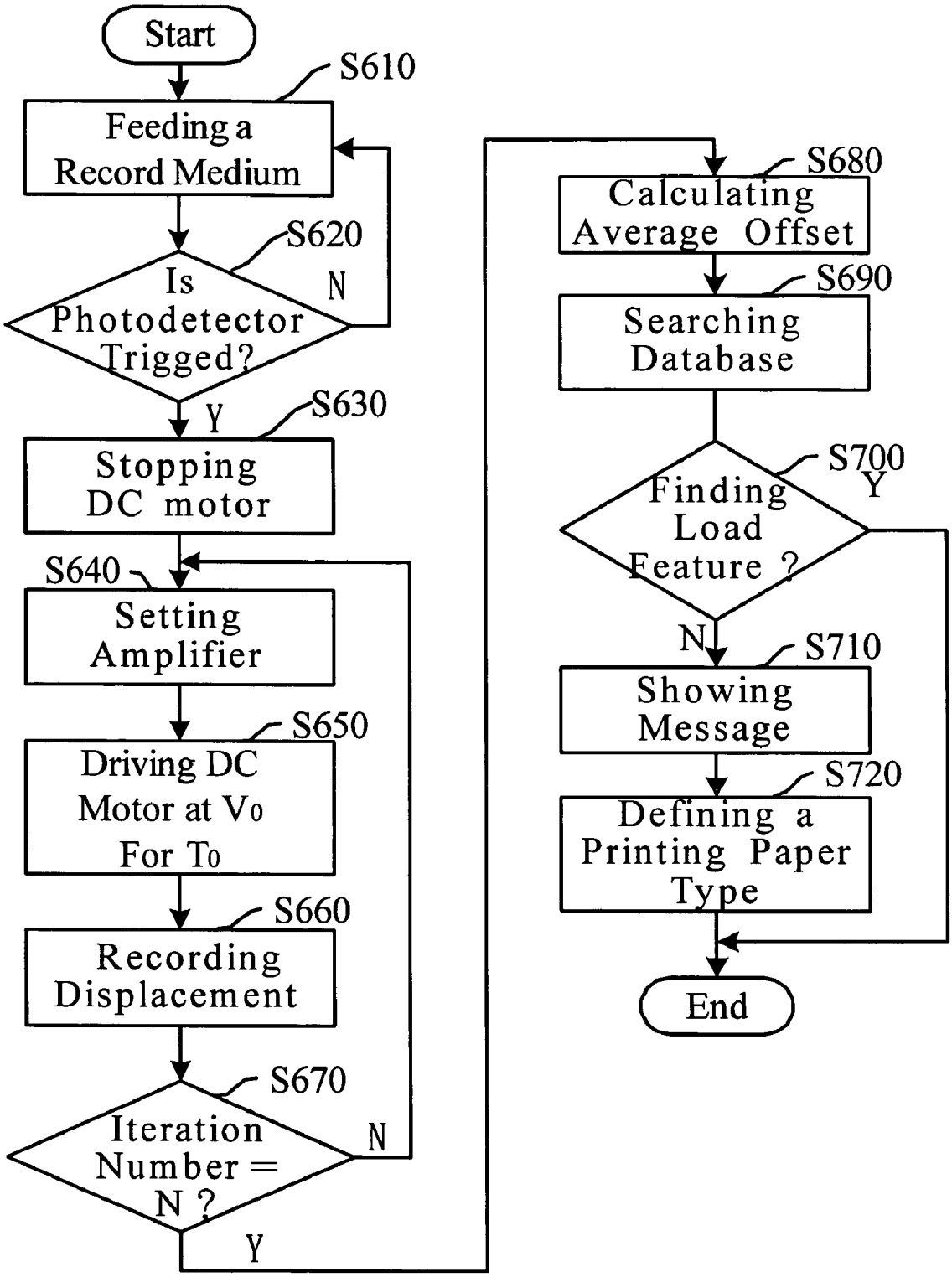
FIG. 6 is a flowchart of an automatic identification method for printer recordable media in accordance with the invention.

FIG. 6 is a flowchart of an automatic identification method for printer recordable media in accordance with the invention. Step S610 places a record medium 310 to a paper feed cartridge and subsequently activates the DC motor 220 to deliver the record medium 310. Similarly, when the leading edge of the record medium 310 is at point A of FIG. 3 or point B of FIG. 4, due to the initial inertia and friction, a displacement of the record medium 310 measured from the point A or B has great error. In step S620, the leading edge of the record medium 310 is periodically checked to see if it triggers the photodetector 280. When the photodetector 280 is triggered, it indicates that the leading edge of the record medium 310 has reached point D. The photosensor 240 can also be used to detect that the leading edge of the record medium 310 has reached point C.

Step S630 immediately stops the DC motor 220 and starts to measure the load feature of printing material of the record medium 310 based on the point C or point D. Step S640 sets an output of the amplifier 260 to $V_o$ volts, wherein $V_o$ has the same value as that in step S540. Step S650 drives the DC motor 220 at $V_o$ for $T_o$, wherein $T_o$ has the same value as that in step S550. Step S660 stops the DC motor 220 and records a displacement fed back by the photosensor 240. Step S670 executes steps S640 to S660 N times. Step S680 calculates an average displacement based on the N times executed for the load feature of the printing material.

Step S690 accordingly searches the database of the respective load features in the non-volatile memory 290 for the record medium 310. Step S700 determines if the record medium 310 has been found. When the load feature matched with a respective load feature in the database is determined, the record medium 310 is successfully identified. For example, if the average displacement is measured as 30, the printing material is the transparent slide in accordance with Table 1. Because some conditions such as temperature and humidity changes may affect the measured result, a certain tolerance is allowed. For example, when the average displacement is measured as 29, the printing material can be still determined as the transparent slide.

In step S700, when there is no the load feature matched with a respective load feature in the database, it indicates that the record medium 310 is not defined by the printer manufacturer. Step S710 displays a "finding an undefined record medium" message, which can be produced by the host 300 or the user interface of the printer. Step S720 asks the user to define a printing paper type for the record medium and writes it in the non-volatile memory 290 of the database. Accordingly, when the user uses the record medium 310 next time, a correct determination can be made in accordance with the user-defined printing paper type.

Table 2 shows an example of user-defined record medium. In Table 2, the user defines two record media 310, one as photographic paper and the other as inkjet paper. When the load feature of a record medium 310 to be printed is measured as six, the printer determines the record medium 310 as a user-defined photographic paper and accordingly uses the setting and method of the photographic paper in printing. When the load feature is measured as 70, the printer determines the record medium 310 as a user-defined inkjet paper and accordingly uses the setting and method of the inkjet paper in printing. As such, the automatic identification range of printing materials is not limited by means of such a user-defined way, and thus papers typically used by the user can be easily included in the automatic identification range of printing materials and printed by the optimal manner to obtain the best printing effect.

TABLE 2

| | Paper Type | | | | | |
|---|---|---|---|---|---|---|
| | Photo Paper | Inkjet Paper | Plain Paper | Transparent Slide | User-Defined Photo Paper | User-Defined Inkjet Paper |
| Average Offset Unit (1/2400 inch) | 10 | 80 | 100 | 30 | 6 | 70 |

As cited, the invention uses inherent devices in the paper feed mechanism of a printer to avoid the prior problems of requiring special processing for a record medium in the printer and using an additional LED and photosensor, thereby reducing the cost. The invention can also overcome the prior problem that a record medium not defined by the printer manufacturer cannot be identified automatically.

Although the present invention has been explained in relation to its preferred embodiment, it is to be understood that many other possible modifications and variations can be made without departing from the spirit and scope of the invention as hereinafter claimed.

What is claimed is:

1. An automatic identification system for printer recordable media, which can detect different recordable media with different load features to be printed by a printer, the system comprising:

a transport device for delivering the different recordable media;

a driving device, which is connected to the transport device and drives the transport device;

a photo encoder, which is configured on the transport device such that the photo encoder produces a position signal respectively of the different recordable media when the transport device delivers the different recordable media;

a photosensor, which is connected to the photo encoder and detects the position signals; and a processor, which receives and processes the position signals to thus identify the different recordable media.

2. The system as claimed in claim 1, wherein the driving device is a motor.

3. The system as claimed in claim 2, wherein the motor is rotated with a predetermined torque for a predetermined time, and the transport device delivers the different recordable media to different positions in accordance with the load features respectively of the different recordable media.

4. The system as claimed in claim 3, further comprising an amplifier, which is connected to the motor and outputs a control signal to rotate the motor with a predetermined speed for the predetermined time.

5. The system as claimed in claim 1, wherein the processor further comprises a position pulse counter to convert the position signals into digital position signals.

6. The system as claimed in claim 1, further comprising a photodetector, which is connected to the processor and produces a locating signal to the processor when the different recordable media reaching a predetermined position is detected.

7. The system as claimed in claim 1, further comprising a non-volatile memory, which is connected to the processor and records positions of the different recordable media when the motor is rotated with a predetermined torque for a predetermined time.

8. The system as claimed in claim 1, wherein the transport device further comprises a first roller and a second roller, and axes of the first roller and the second roller are parallel to each other.

9. The system as claimed in claim 1, wherein the different recordable media comprise an opaque record medium and a transparent recordable medium.

* * * * *

UNITED STATES PATENT AND TRADEMARK OFFICE

CERTIFICATE OF CORRECTION

PATENT NO. : 7,614,718 B2
APPLICATION NO. : 11/401236
DATED : November 10, 2009
INVENTOR(S) : Chen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 873 days.

Signed and Sealed this

Nineteenth Day of October, 2010

David J. Kappos

David J. Kappos
*Director of the United States Patent and Trademark Office*